US006048137A

United States Patent [19]

Beck, III

[11] Patent Number: 6,048,137

[45] Date of Patent: Apr. 11, 2000

[54] DRILLED, CAST-IN-PLACE SHELL PILE AND METHOD OF CONSTRUCTING SAME

[76] Inventor: August H. Beck, III, 10 Hearthwood, San Antonio, Tex. 78248

[ * ] Notice: This patent is subject to a terminal disclaimer.

[21] Appl. No.: 08/743,980

[22] Filed: Oct. 31, 1996

[51] Int. Cl.[7] ..... F02D 5/34

[52] U.S. Cl. ..... 405/233; 405/249; 405/239

[58] Field of Search ..... 405/229, 231, 405/232, 233, 236, 239, 240, 243, 245, 249, 257

[56] References Cited

U.S. PATENT DOCUMENTS

| | | | |
|---|---|---|---|
| 1,114,505 | 10/1914 | Moore . | |
| 1,665,798 | 4/1928 | Sipe | 405/240 X |
| 2,512,831 | 9/1950 | Holmes | 405/239 |
| 3,307,643 | 3/1967 | Ferri . | |
| 4,158,518 | 6/1979 | Rusche | 405/240 |
| 4,697,649 | 10/1987 | Kinnan . | |
| 4,697,959 | 10/1987 | Kinnan . | |
| 4,790,689 | 12/1988 | Henn et al. | 405/240 |
| 5,259,702 | 11/1993 | Simpson | 405/233 |
| 5,294,215 | 3/1994 | Millgard | 405/233 |
| 5,320,452 | 6/1994 | Kunito | 405/233 |
| 5,356,241 | 10/1994 | Kunito . | |
| 5,490,743 | 2/1996 | Vales | 405/266 |
| 5,516,237 | 5/1996 | Hebant | 405/233 |
| 5,586,417 | 12/1996 | Henderson et al. | 405/233 X |

FOREIGN PATENT DOCUMENTS

| | | |
|---|---|---|
| 7527439 | 4/1976 | France . |
| 1 484 589 | 11/1971 | Germany . |
| 37 16750 | 12/1988 | Germany . |
| 2-186009 | of 1990 | Japan . |
| 4-44596 | 2/1992 | Japan . |

OTHER PUBLICATIONS

Reese, Lymon C., and Reavis, Gordon, T., Engineering Characteristics of the Geojet Foundation System, (Jan. 1994).

Informational Brochure on The Geojet System (undated).

*Primary Examiner*—David J. Bagnell
*Assistant Examiner*—Federick L. Lagman

[57] ABSTRACT

A drilled, cast-in-place shell pile in the form of a cementacious pipe surrounding an earthen core. The pile is cast in an annular kerf drilled in the soil with a rotating hollow cylindrical core barrel. The earthen core within the annular kerf remains in place to form the core of the shell pile and act as a form. The cylindrical shell of the pile transfers load from above to the soil mass below through skin friction, and may be reinforced against tension loads by a plurality of reinforcing bars. The earthen core has end bearing capabilities to assist in transferring loads from above. Soil excavated from the annular kerf may be mixed with cement to form a cementitious soil/cement mixture to be pumped into the annular kerf to form the cylindrical shell. This cementitious mixture, while in a fluid state, is pumped into the excavation as the core barrel is removed. A mixing/circulating unit is provided for on-site mixing of dry cement with the cuttings and other materials to form the cylindrical shell. The shell pile may be used in soil solidification or soil improvement applications, or a plurality of such shell piles may be constructed as secant wall shell piles to form a cementitious barrier against lateral migration of moisture, soil contaminants, or other substances.

20 Claims, 11 Drawing Sheets

DRILLED, CAST-IN-PLACE SHELL PILE AND METHOD OF CONSTRUCTING SAME

FIELD OF THE INVENTION

The invention relates generally to piles used for foundations and barriers in the construction industry. More particularly, the invention relates to the construction and use of cast-in-place shell piles comprising a cementitious outer shell and an earthen core.

BACKGROUND OF THE INVENTION

Conventionally, three basic types of deep foundations have been used in the construction industry. The first such type is the driven pile, which is typically manufactured off-site and transported to the construction site, where it is then driven into the ground. Driven piles can be made from a variety of different materials and in a variety of different shapes. These include the pre-cast concrete square pile, wood pile, steel "H" pile, steel pipe pile, and mandrel-driven step tapered piles. A conventional mandrel-driven tapered pile displaces ground below it as it is driven into the ground, and is then filled with ready-mix concrete. A common size for pre-cast piles is 16 inches square in cross-section, and often multiple such driven piles are grouped together and topped by a cap for supporting the load presented by the remainder of the foundation and the overlying structure.

A second type of conventional pile is made from drilled shafts. Drilled shafts are drilled excavations which are filled with reinforcing steel cages and concrete. Drilled shaft diameters are typically large (e.g., 18 inches to 72 inches or more), and they are usually poured to the surface of the existing grade, since no cap is required. Drilled shafts are also used to form barriers when installed in the form of secant wall piles, wherein adajcent drilled shafts are positioned so that they intersect along one side of their outer diameters. Such barriers may be used to prevent the migration of soil contaminants or moisture past a boundary defined by the secant wall piles.

A third type of conventional pile is auger cast piling, which has characteristics of both drilled shafts and driven piling. Auger cast piles are continuous auger flight excavated piling. As the continuous flight auger is retracted, a cement grout is added through the auger to fill the excavation. Steel reinforcing, typically in the form of a steel cage or a single steel reinforcing bar, is then added. Auger cast is usually used in soft ground conditions.

The selection of the type of deep foundation to be used is typically based on numerous factors. Chief among these factors are the geologic characteristics of the ground in which the foundation is to be placed. The hardness of the ground, the moisture content, and the presence of rocks are all characteristics which are often taken into consideration. For instance, in harder ground, usually drilled shafts are used. In softer grounds, usually the driven pilings are used.

Each of these conventional piles has certain disadvantages. Driving piling, for example, causes vibration during installation. This vibration may cause damage to nearby structures. Furthermore, the noise attendant with driving piling often makes it an unacceptable foundation system for constructions near populated urban areas. A further disadvantage of driven piling is that most such piles are fabricated offsite, necessitating their transportation to the job site. Such transportation can be expensive, especially when the job site is in a remote area.

Large-diameter drilled shafts also have numerous disadvantages. A principal disadvantage is the low ratio of surface area to volume of material. Deep foundations are typically designed to maximize skin friction (which is proportional to the external surface area of the pile or group of piles) relative to the volume of material required to construct the piles. Piling elements of relatively smaller cross-section, such as most driven piling and auger cast piling, have more skin friction per unit volume of material (concrete and reinforcing steel) than a drilled shaft. For example, four 18-inch diameter piles have the same skin friction value as one 72-inch diameter drilled shaft, yet use only 25% of the volume of concrete and reinforcing steel required for the larger-diameter drilled shaft.

Drilled shafts have the further disadvantage that, in engineering assessments, they are often assigned no end bearing capabilities. The bottoms of drilled shafts are often difficult to inspect for cleanliness, soil characteristics, and other indicia of end bearing capabilities. Consequently, drilled shafts are typically assigned little, if any, end bearing capabilities.

Drilled shafts and auger cast also share the disadvantage that they are time dependent on the timely delivery of the cementitious material which will be placed to form the pile. Waiting for delivery of the material can result in costly and inconvenient schedule disruptions and delays.

Drilled shaft and auger cast share the further disadvantage that during installation large volumes of spoil dirt are brought to the surface. Because these piles require excavation, large volumes of dirt, rocks and other earthen material are displaced and must be removed from the construction site. Often, this earthen material is contaminated with hazardous chemicals and the like, and disposal of the contaminated refuse may be difficult or impossible. Where sub-surface contamination is known to exist, the use of drilled shafts and auger cast may often be avoided so as not to make the problem worse by creating a surface contamination. Even clean spoil dirt removed form the excavation and brought to the surface has to be disposed of, and such disposal is costly even if no contaminants are present.

SUMMARY OF THE INVENTION

In view of the foregoing disadvantages of known foundation piles, it is an object of the present invention to provide a piling suitable for use in both soft ground and hard ground.

It is a further object of the present invention to provide a piling which is excavated rather than driven, thereby reducing noise and vibration during installation.

It is a further object of the present invention to provide a piling which is cast in place at the construction site to avoid costly transportation of pre-cast or prefabricated elements.

It is a further object of the present invention to provide a piling having a relatively large ratio of surface area, or skin friction, to the volume of material transported to the job site for constructing the piling.

It is a further object of the present invention to provide a relatively larger diameter piling which has substantial end bearing capabilities.

It is a further object of the present invention to provide an excavated piling requiring a relatively small amount of cementitious material which can be prepared on-site rather than transported to the construction site.

It is a further object of the present invention to provide a piling which can be constructed in a manner so as to leave a minimum amount of excavated earthen material for disposal.

It is a further object of the present invention to provide a piling with the foregoing advantages which can also be used to form secant wall piles.

In accordance with these and other objects, the invention provides a drilled, cast-in-place shell pile in the form of a cementacious pipe surrounding an earthen core. The pile is cast in an annular kerf drilled in the soil with a rotating hollow cylindrical core barrel. The core barrel employs cutting means to cut an annular kerf suitable for filling with cementitious material to form a cylindrical shell. When used as foundation piling, the cylindrical shell of the pile transfers load from above to the soil mass below through skin friction, and may be reinforced against tension loads by a plurality of reinforcing bars or comparable reinforcing means.

According to a second aspect of the invention, the earthen core within the annular kerf remains in place to form the core of the shell pile. The earthen core has end bearing capabilities and thereby assists in transferring loads from above, yet it represents significant volumetric mass of the pile that need not be purchased, mixed, or transported to the construction site. The core also acts as an inside form.

According to a third aspect of the invention, the soil excavated from the annular kerf may be captured as it exits the kerf and mixed with cement and other additives to form a cementitious soil/cement mixture to be pumped into the annular kerf to form the cylindrical shell. This cementitious mixture, while in a fluid state, is pumped into the excavation as the core barrel is removed. Re-use of the cuttings to form the cementitious cylindrical shell of the pile minimizes the amount of spoil which must be disposed of, and likewise minimizes the amount of material needed to construct the pile.

According to a fourth aspect of the invention, there is provided a mixing/circulating unit for on-site mixing of dry cement with the cuttings and other materials to form the cylindrical shell. The mixing/circulating unit filters cuttings from the drilling fluid returned from the excavation, thus cleaning the drilling fluid for re-use. The mixing/circulating unit also mixes filtered soil cuttings with water, cement, and potentially other materials to form a cementitious material for filling the annular kerf upon removal of the core barrel, thereby creating the cementitious cylindrical shell of the cast-in-place shell pile.

The drilled, cast-in-place shell pile may be installed alone or in groups under caps similar to driven piles and auger cast piling. The shell pile of the present invention combines certain advantages from each of driven piling, drilled shafts and auger cast. Like driven piling, it offers a small material volume per unit of load transfer; little or no spoil material has to be removed from the job; and it is relatively easy to install. Like drilled shafts, the shell pile of the present invention does not pose vibration or noise problems, and it can be installed in either hard or soft ground.

The drilled, cast-in-place shell pile of the present invention also has certain advantages over drilled shafts, driven piling, and auger cast. First, it has less volume of material per unit of load transfer. For example, a shell pile according to the present invention having a 30-inch outer diameter and a three-inch thick shell would have approximately the same cementitious volume as a 16-inch square pre-cast pile or an 18-inch diameter auger cast pile. Yet it would have 1.47 times the surface area of the driven pile and 1.67 times that of the auger cast. And it would have the same surface area as a 30-inch diameter drilled shaft, yet only 36% of the cementitious volume of the drilled shaft.

Second, the cast-in-place shell pile of the present invention has significant end bearing capabilities. Through skin friction at the inner surface of the cylindrical shell and the surface of the earthen core, load is transferred to the core. Some of this load is borne directly by the earthen core at the bottom face of the shell pile, thereby effecting end bearing at the lowermost portion of the shell pile. This compares favorably to other relatively large diameter piles such as drilled shaft piles, which are not typically attributed end bearing capabilities in load bearing analysis.

Third, the cast-in-place shell pile of the present invention is not affected by the existence of a water table above the depth to be drilled. The viability of drilled shafts and the cost of constructing them are heavily dependent on the existence of a water table, which can cause caving of the soil during excavation. The cast-in-place shell pile is constructed in such a way that water and soil surrounding the excavated shell are kept from inundating the excavation by the presence of the core barrel, which may be removed only when cementitious material has been added to substantially fill the kerf below the cutting face of the core barrel.

Fourth, the drilled, cast-in-place shell pile is not critically dependent on material delivery timing. Bulk cement can be delivered to the job site, with no waiting on ready-mix delivery or costly trucking and handling of piling elements, thereby permitting high production rates.

The cast-in-place shell pile of the present invention is also suitable for use in soil solidification and soil improvement applications. Piles are often used to solidify soil underneath a surface on which construction activity is to take place. One example is underneath the surface of a parking lot, where it is desired to minimize soil subsidence. Piling is also used in areas where it is desired to improve soil conditions where contaminants or other undesirable substances are present in the soil. The placement of piling is an effective way to neutralize these soil conditions. The shell pile of the present invention may be advantageously employed in both of these applications.

The cast-in-place shell pile of the present invention is also suitable for use as secant piling, wherein multiple such shell piles are constructed such that they intersect at their outer diameters to form a barrier against the migration of moisture, soil contaminants, etc.

BRIEF DESCRIPTION OF THE DRAWINGS

The present invention is more easily understood with reference to the drawings, in which.

DETAILED DESCRIPTION OF THE PREFERRED EMBODIMENT

Figure 1A:
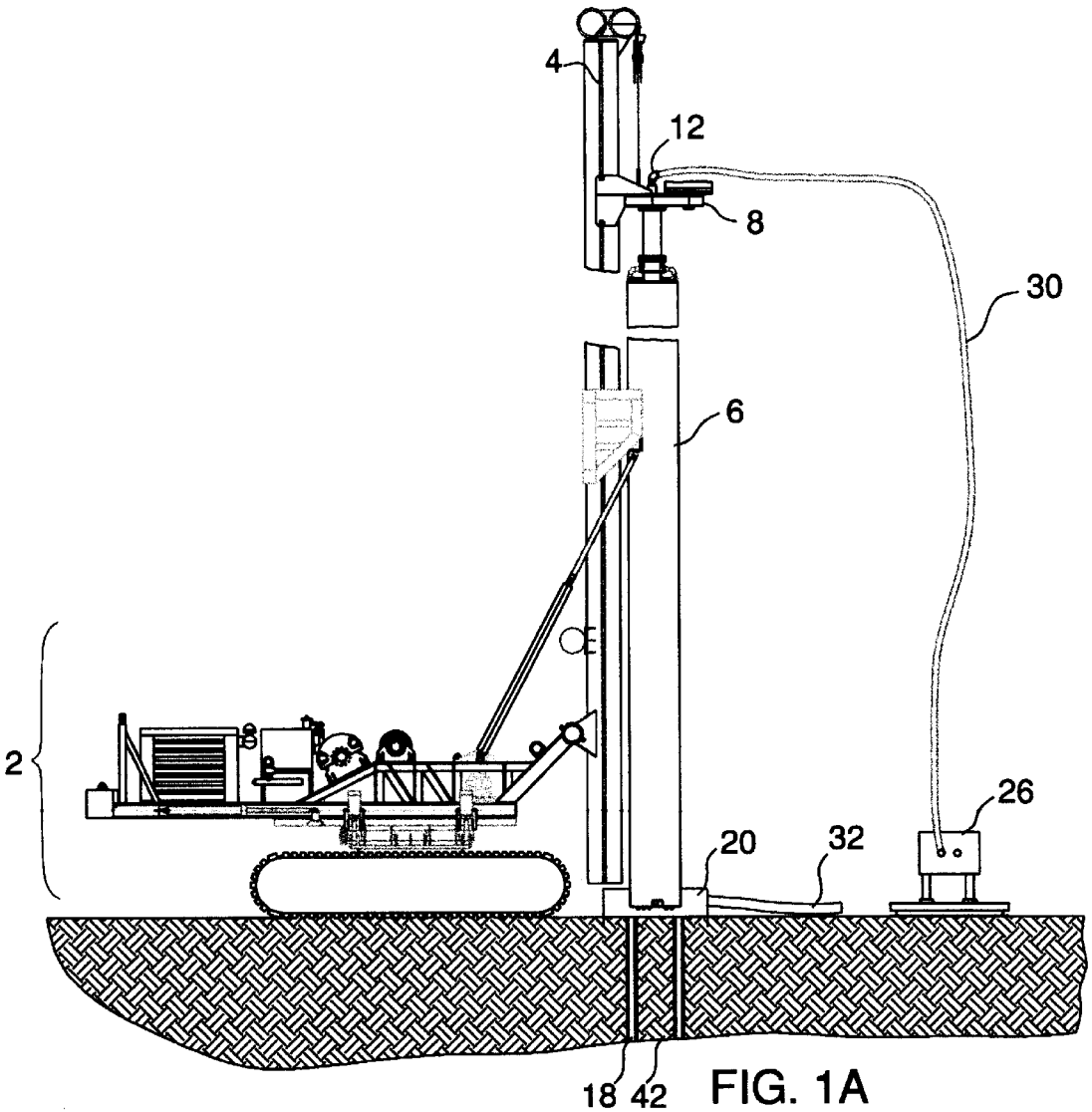
FIG. 1A is a side plan view of an assembly of equipment including a drilling platform and a core barrel for constructing a cast-in-place shell pile according to the present invention.
Figure 1B:
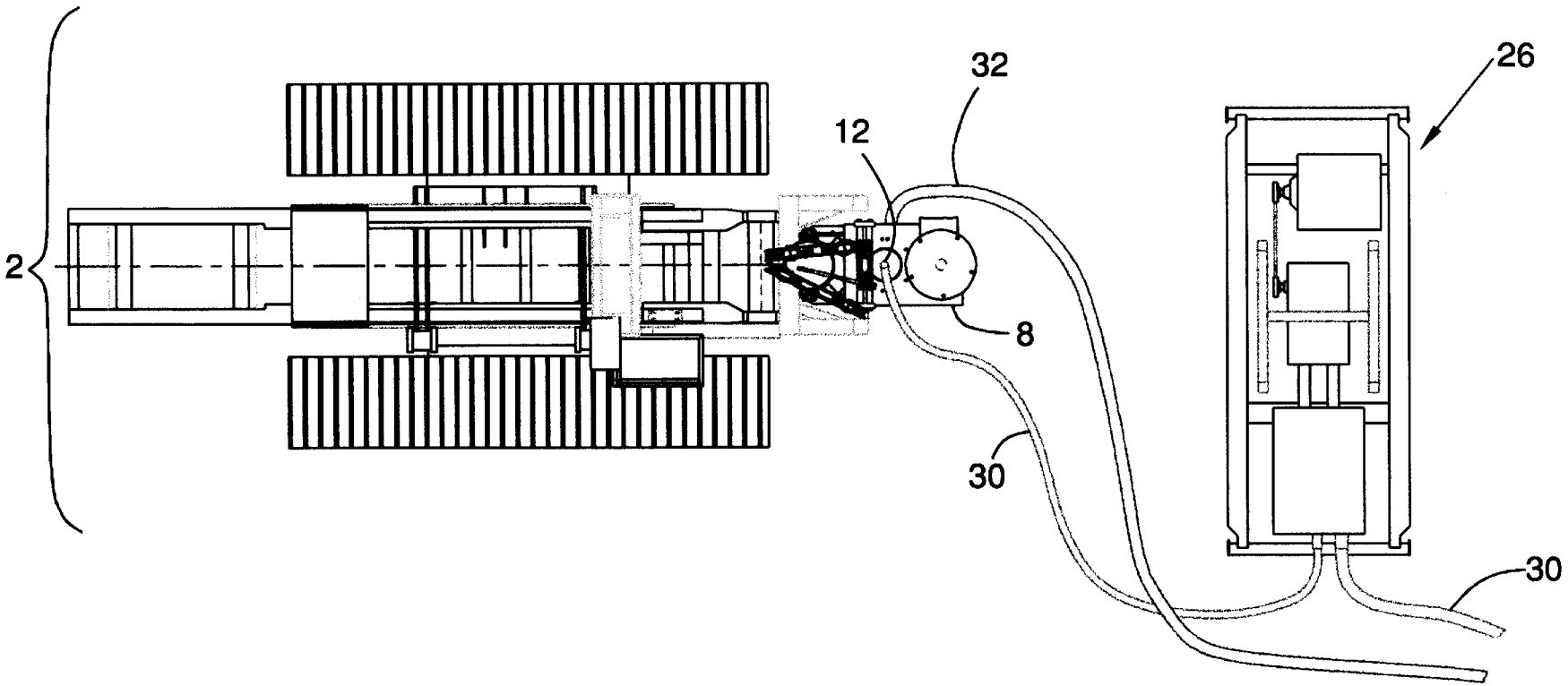
FIG. 1B is a top plan view of the equipment assembly of FIG. 1A.

The shell pile according to the present invention is constructed using rotary drilling equipment, much as with auger cast piling. As shown in FIG. 1A, a set of leads 4 on drilling platform 2 supports top drive 8, which is slidably mounted on the drilling platform. Drilling platform 2 may be a crane or excavator-type crawler, or other similar type of machinery. Top drive 8 supports core barrel 6 suspended therefrom, and also rotates core barrel 6, preferably at speeds in the range of 30 to 60 revolutions per minute.

Figure 4A:
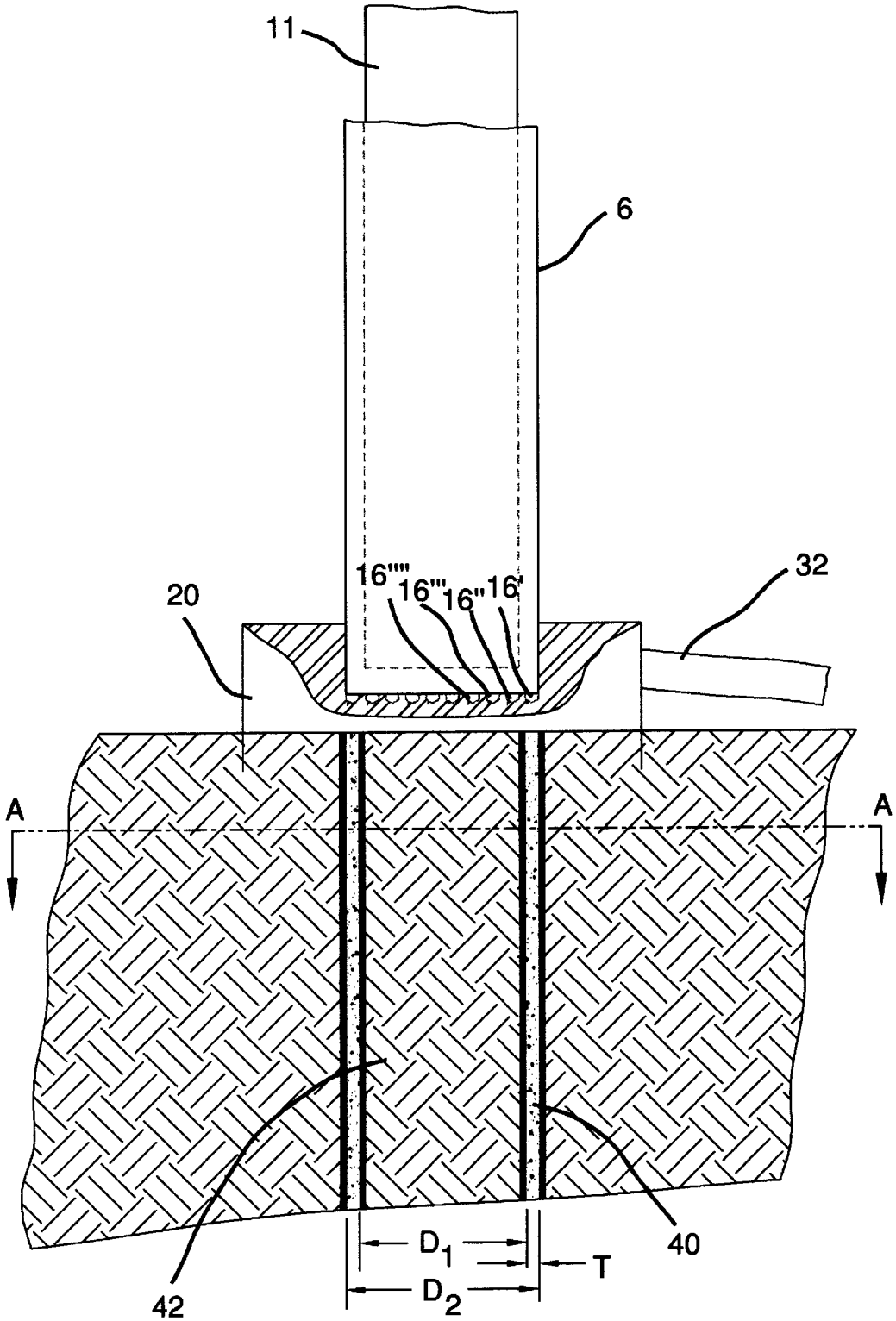
FIG. 4A is an enlarged side view of the core barrel 6 of FIG. 1A, together with a cross-sectional view of cylindrical shell 40 and earthen core 42 forming a shell pile according to the present invention.

Referring now to FIG. 4A, hollow core barrel 6 is provided at its lower end with cutting means formed of cutters 16', 16", 16'", and 16"" shown in the cut-away view through conductor 20. The cutting means may be either a plurality of fixed cutters shown in the Figure, wheel-type cutters, or a combination of both. The number, placement, and type of the cutters, as well as the rotation speed of the core barrel 6, will depend on numerous factors, including the characteristics of the earthen material to be drilled, the depth to be drilled, the existence of sub-surface strata of rock, etc.

Figure 5:
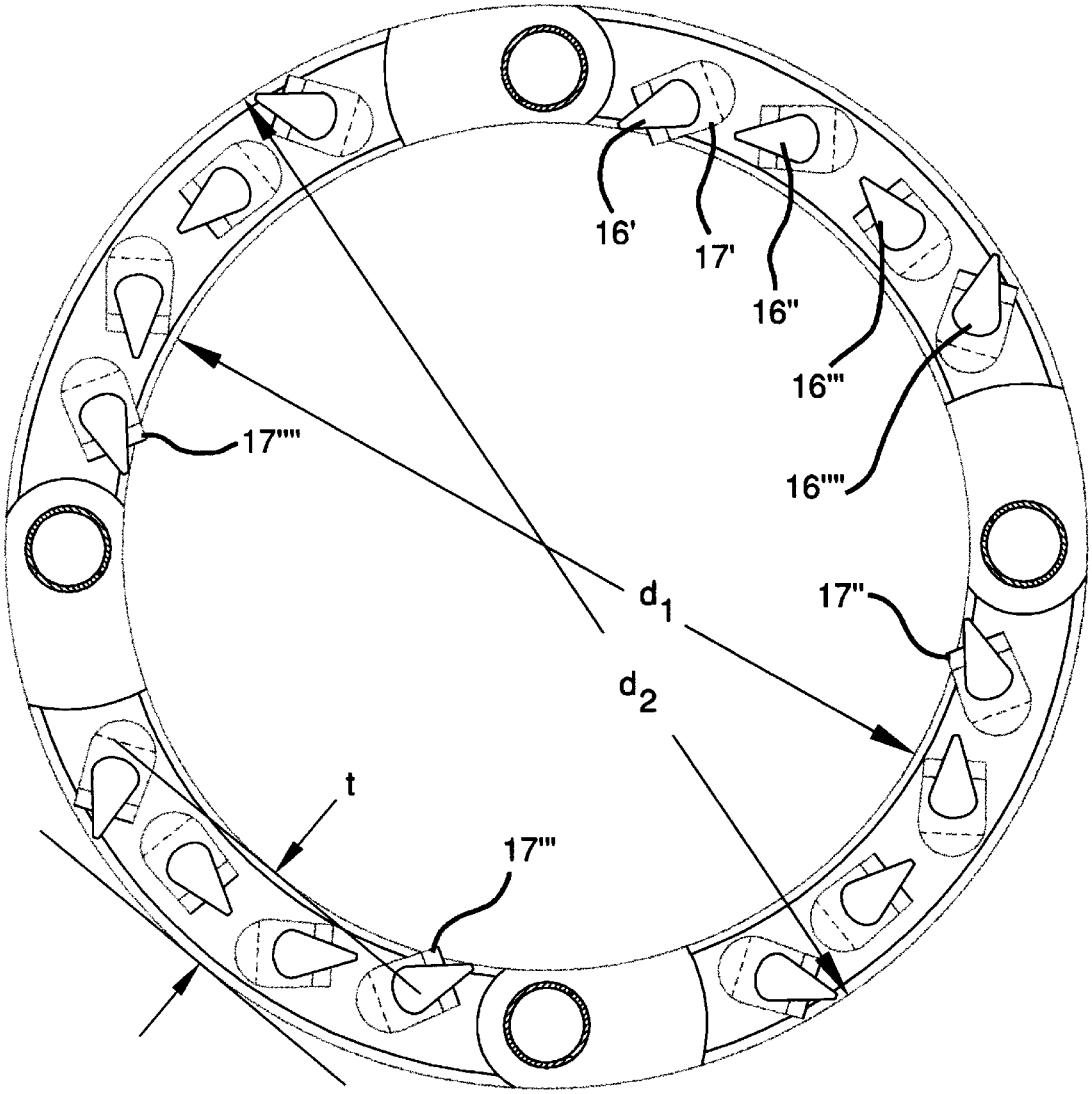
FIG. 5 shows the cutting face of core barrel 6, including cutting means for cutting an annular kerf for a cast-in-place shell pile.

Cutters 16', 16", 16'", and 16"" are preferably sized to cut an annular kerf 18 (FIG. 1A) of sufficient width to allow core barrel 6 to proceed without interference during drilling. This relationship is shown in FIGS. 4A and 5. Beginning with FIG. 5, there is shown a plurality of cutters 16', 16", 16'", and 16"" mounted to core barrel 6 at its base. In the embodiment illustrated, the cutters are a plurality of fixed cutters, typically fabricated from tungsten carbide or other hard material. Core barrel 6 has a wall defining an inner diameter $d_1$, an outer diameter $d_2$, and a thickness t. Cutters 16', 16", 16'", and 16"" preferably cut a swath wider than the thickness t of core barrel 6 to produce an annular kerf having a thickness greater than t.

Thus, there is shown in FIG. 4A an annular kerf filled with cementitious material to form cylindrical shell 40 around earthen core 42. Cylindrical shell 40 (FIG. 4A) is substantially vertical to support the load offered by a foundation of a building, bridge, or other similar structure. Cylindrical shell 40 has a thickness T>t. Equivalently, cylindrical shell 40 has an inner diameter $D_1$ which is less than inner diameter $d_1$ of core barrel 6, and an outer diameter $D_2$ which is greater than outer diameter $d_2$ of core barrel 6. These clearances at the inner and outer walls of core barrel 6 are selected to allow for progress of the core barrel unimpeded by contact with the walls of annular kerf 18, and may depend on the depth to be drilled (greater depths may require greater clearances), the composition of the soil, and other factors. Typical dimensions of a shell pile according to the present invention would be an outside diameter $D_2$ of 30 inches and an inside diameter $D_1$ of 24 inches, yielding a shell thickness T of 3 inches. Drilled depths would typically range from 30 to 80 feet, but may exceed 100 feet.

Figure 2A:
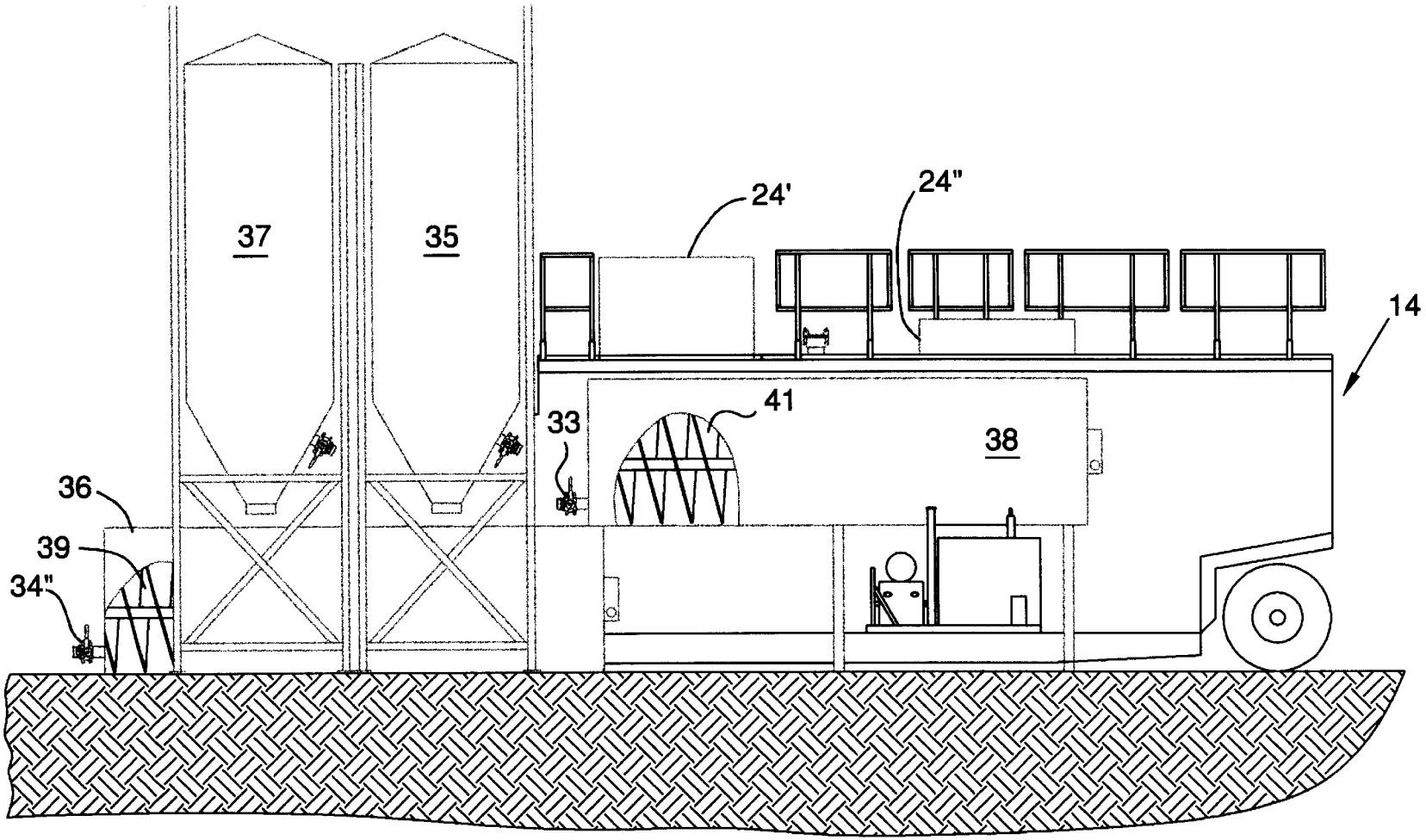
FIG. 2A is a side plan view of an assembly of equipment for circulating drilling fluid and mixing cementitious material used in constructing a cast-in-place shell pile.
Figure 2B:
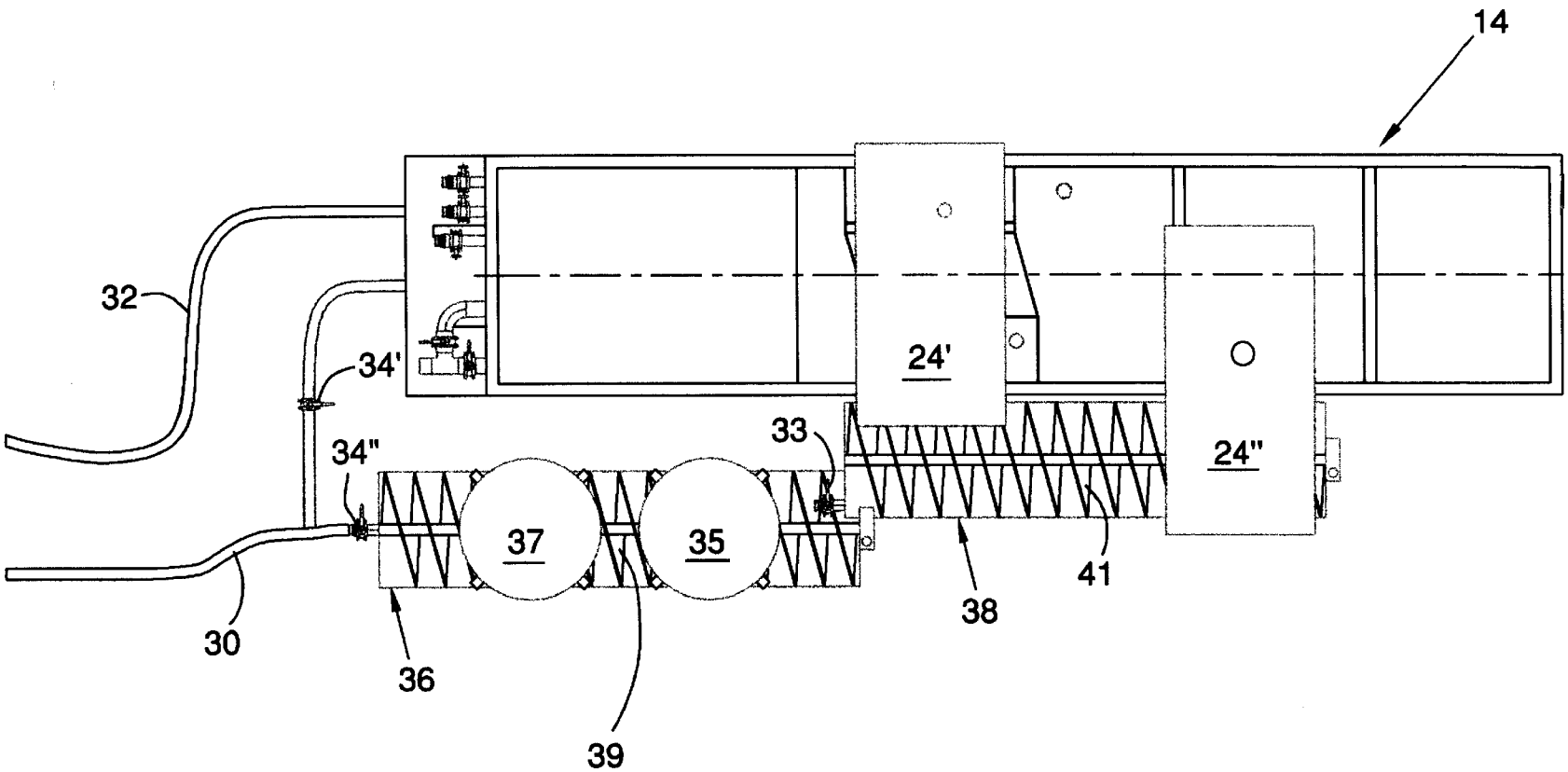
FIG. 2B is a top plan view of the equipment assembly of FIG. 2A.
Figure 3A:
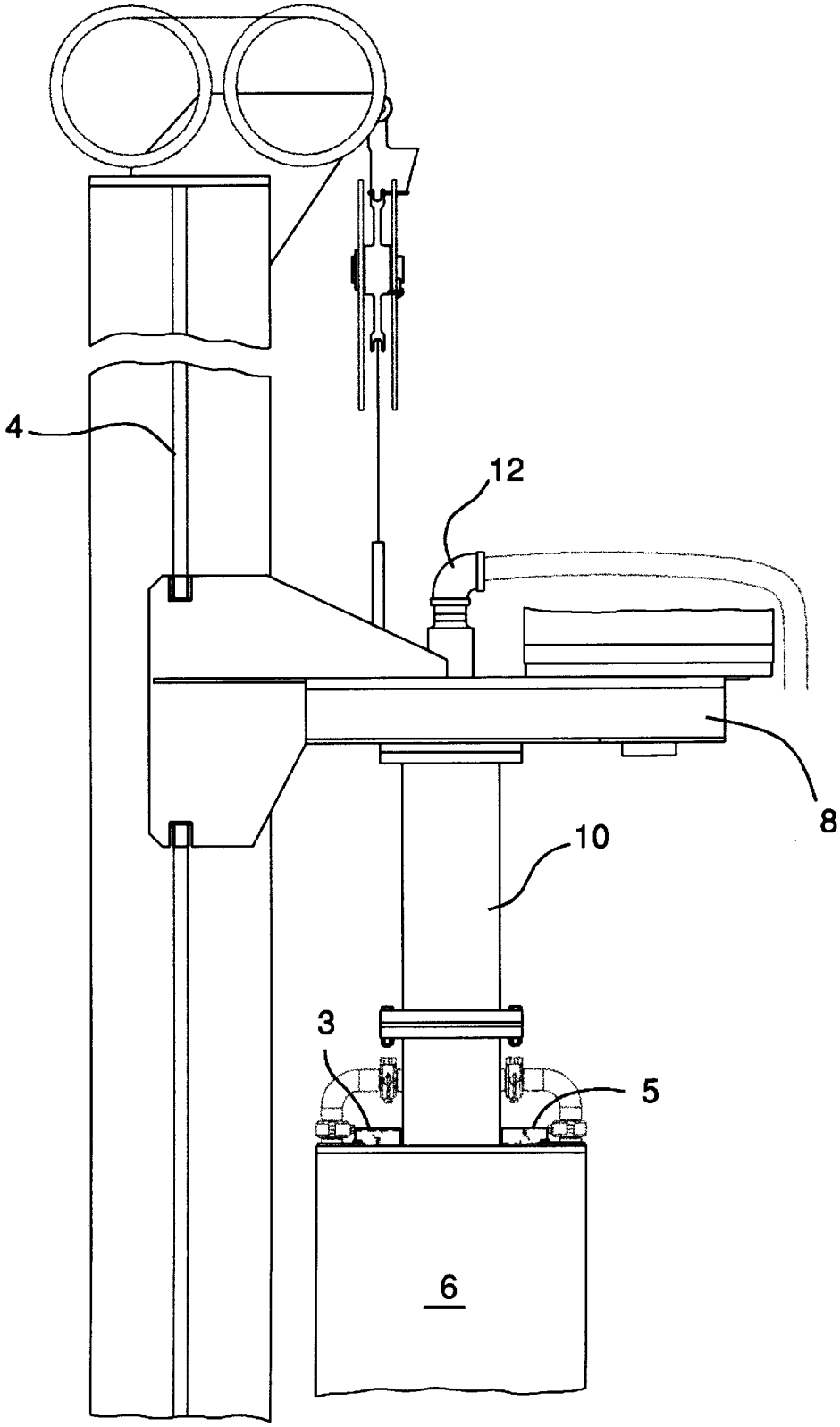
FIG. 3A is an enlarged side view particularly showing swivel and drive mechanisms of the drilling platform of FIG. 1A, together with a core barrel according to the present invention.
Figure 3B:
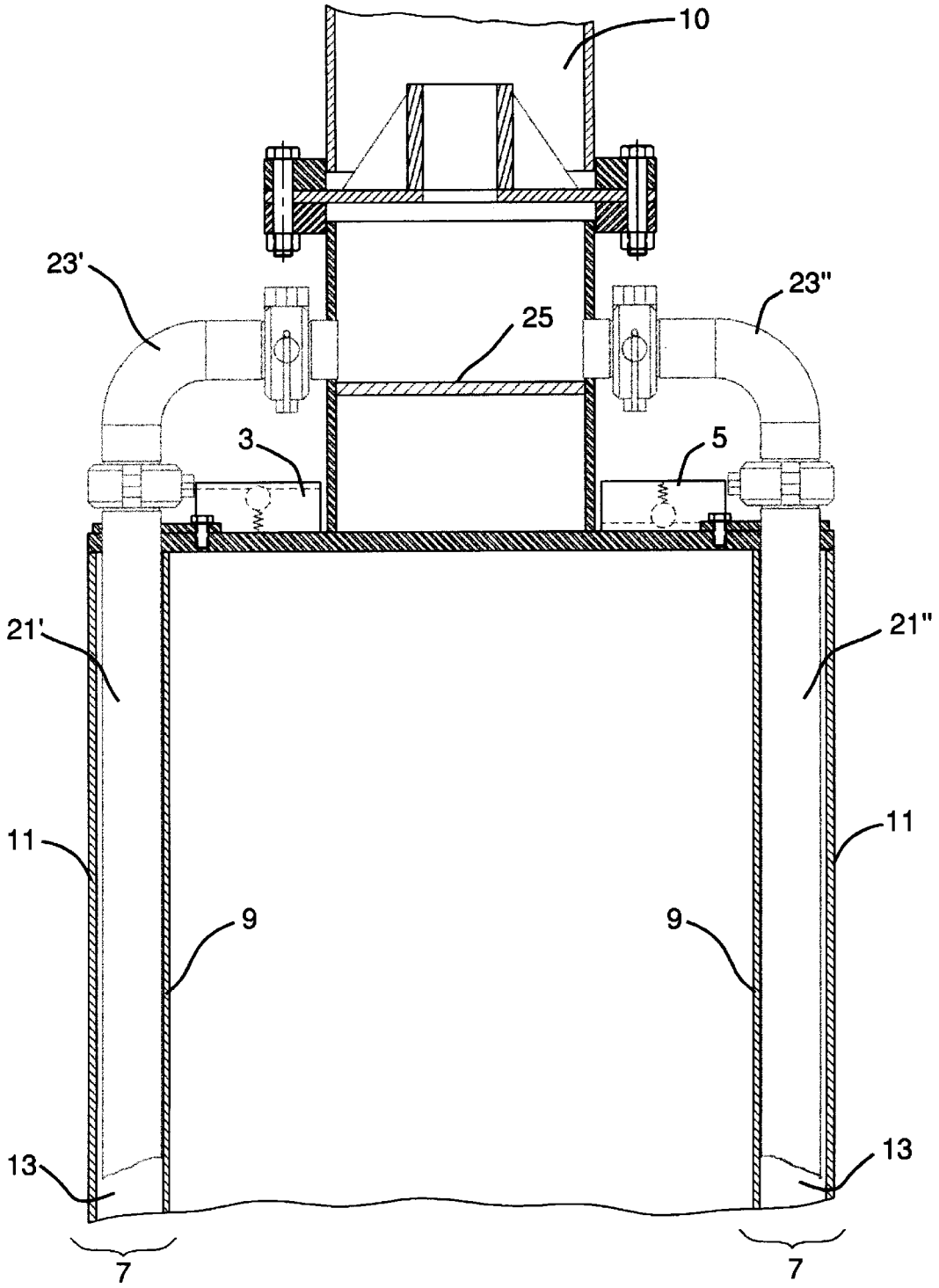
FIG. 3B is a partial cross-section of the core barrel and drive mechanism of FIG. 3B.

The process of drilling annular kerf 18 and constructing a cast-in-place shell pile is now described with particular reference to FIGS. 1A, 1B, 2A, 2B, 3A and 3B. FIG. 3A shows core barrel 6 suspended from top drive 8, which rotates core barrel 6. Core barrel 6 and top drive 8 are preferably interposed by drill pipe extension 10 to permit core barrel 6 to be lowered completely to the ground when top drive 8 cannot be lowered all the way due to limitations inherent in the construction of drilling platform 2. Referring to FIG. 3B, core barrel 6 preferably has a hollow wall 7 comprising inner wall 9 and outer wall 11. Inner wall 9 and outer wall 11 define a channel 13 in which drilling fluid may pass to reach cutters 16', 16", 16'", and 16"" on the cutting face of core barrel 6, as described more particularly below. Using this hollow wall configuration, an outer wall of diameter 30 inches and thickness of ⅝ inch, and an inner wall of diameter 24 inches and thickness of ½ inch can be expected to provide satisfactory results.

Upon commencement of drilling, duplex pump 26 (FIG. 1B) pumps drilling fluid from mixing/circulating unit 14 (FIG. 2B) through filling conduit 30. During drilling, valve 34' is open and valve 34" is closed (FIG. 2B). Drilling fluid from filling conduit 30 enters rotary swivel 12 (FIGS. 1A and 3A) located above top drive 8, and is forced to flow down through drill pipe extension 10 and then into channel 13 of the hollow wall of core barrel 6 toward cutters 16', 16", 16'", and 16"". As drilling proceeds into annular kerf 18, the drilling fluid is forced across the cutters, and upward past the outer diameter of core barrel 6. This circulatory flow cools and washes the cutters and carries cuttings up between the outer diameter of core barrel 6 and the outside diameter of annular kerf 18. A pressure relief valve 5 (FIG. 3A) is preferably provided near the top of core barrel 6 to prevent the build-up of air pressure within core barrel 6 above earthen core 42 during drilling. Internal pressure build-up tends to reduce drilling efficiency, and a pressure relief valve rated at 5 psi can be expected to provided acceptable pressure relief.

The drilling fluid is preferably a mixture of water and native mud, although other additives such as bentonite or polymer may be used. These other additives may be selected so as to increase the density of the drilling fluid, thereby enabling cuttings to be more easily suspended and brought to the surface of the excavation by the circulating drilling fluid. They may also be selected to provide a sealant effect at the outer wall of the cylindrical shell to aid in reducing fluid loss into earthen core 42 and the earth surrounding annular kerf 18.

In an alternative embodiment, a solid-wall core barrel may be used, wherein drilling fluid is simply circulated downward between earthen core 42 and core barrel 6 in the clearance provided by cutters 16', 16", 16'", and 16"" cutting a kerf of inner diameter $D_1$ which is smaller than the inner diameter $d_1$ of core barrel 6. In this embodiment, the drilling fluid may wash a portion of earthen core 42 out of annular kerf 18 during drilling.

As shown in FIGS. 4A and 1A, drilling fluid and cuttings forced from annular kerf 18 are preferably received in conductor 20, which may be a relatively large diameter pipe set in the ground around annular kerf 18 and open to the air. Drilling fluid and cuttings are then delivered from conductor 20 to mixing/circulating unit 14 via return conduit 32. A pump may be employed to move drilling fluid and cuttings through return conduit 32.

Referring now to FIGS. 2A and 2B, there is shown a mixing/circulating unit 14 for cleaning the drilling fluid returned from annular kerf 18 during drilling and for preparing the cementitious mixture which is placed in the kerf to form cylindrical shell 40 (FIG. 4A) after drilling. Preferably, mixing/circulating unit 14 includes initially a tank of water or a mixture of water and bentonite. Drilling commences using this mixture as the drilling fluid. After drilling commences as described above, drilling fluid and cuttings from return conduit 32 enter the tank, where the cuttings become suspended. There is thus provided means for separating cuttings from the returned drilling fluid. The separating means may be screens, hydrocyclones, or a combination thereof. In the preferred embodiment of FIGS. 2A and 2B, returned drilling fluid is first passed through screens 24" for separating coarser cuttings (e.g., sticks, clay balls, etc.). The coarser cuttings are typically not suitable for any use and thus may be discharged from the system. The drilling fluid is next passed through a combination of hydrocyclones and finer screens 24', which separate intermediate-sized particles from the drilling fluid. The drilling fluid, now cleaned of all cuttings except for finer soil particles, is passed to return conduit 30 for recirculation through rotary swivel 12. Drilling continues in this manner until annular kerf 18 is drilled to the desired depth.

Mixing/circulating unit 14 further includes means for mixing a cementitious material for filling annular kerf 18 to form cylindrical shell 40 after drilling of the kerf is completed. In the embodiment of FIGS. 2A and 2B, there is provided a first auger mixer 36 which employs first auger 39 to mix cement from cement silo 35 and fly ash from fly ash silo 37 together with water or other fluid suitable for combining into a cementitious material. Additives such as fluidifiers and retarders may also be used to obtain the desired viscosity and setting characteristics of the cementitious material. Densometers, volumetrics and scales may be used to ensure that the cementitious material contains the proper amount of cement to attain the proper amount of strength. When drilling of annular kerf 18 is completed (FIG. 1A), valve 34' is closed, valve 34" is opened, and duplex pump 26 operates to pump this cementitious mixture through filling conduit 30, swivel 12, and into core barrel 6. It is to be understood that the precise composition of the cementitious material which is placed in the kerf to form cylindrical shell 40 is not critical to the invention, and any number of materials may be added to cement and water any of numerous different proportions to form a suitable cementitious material.

Placement of the cementitious material in annular kerf 18 preferably commences before core barrel 6 is withdrawn from the kerf so that the cementitious material may flow unimpeded through channel 13 of hollow wall 7 to fill the kerf from the bottom. Preferably, volumetric counters and displacement measurements are used to insure proper filling of the excavated annular kerf 18 for quality control. As pumping of the cementitious material continues, core barrel 6 is withdrawn from annular kerf 18, effecting the placement of cementitious cylindrical shell 40 around earthen core 42.

In the preferred embodiment, the cementitious material forming cylindrical shell 40 comprises a portion of soil cut from annular kerf 18 during the drilling process, thus minimizing the amount of spoil to be disposed of and also minimizing the volume of cement and other constituent materials which must be transported to the job site to construct the shell pile. Accordingly, there is shown in FIGS. 2A and 2B a second auger mixer 38 which receives intermediate-sized soil cuttings that have been separated from the drilling fluid by the combination of hydrocyclones and finer screens 24'. Water or native mud drilling fluid is added to the soil cuttings and the resulting composition is mixed by second auger 41. Suitable amounts of this water/soil mixture is then delivered through valve 33 to first auger mixer 36, which is open at the top, thus to create a cementitious material in first auger mixer 36 employing the further steps described above.

As shown in FIG. 3B, drilling fluid and cementitious material are preferably delivered through channel 13 of core barrel 6 by the use of tubes 21' and 21" to prevent overpressurization of channel 13. Typically, four such tubes are employed, each being about 2 inches in diameter to fit comfortably within inner wall 9 and outer wall 11 of core barrel 6, which typically have outer diameter of 24 inches and 30 inches, respectively. Tubes 21' and 21" may be in fluid communication with drill pipe extension 10 via tube couplings 23' and 23", which may be removable to permit unclogging of tubes 21' and 21". Drilling fluid or cementitious material entering drill pipe extension 10 is diverted into tube couplings 23' and 23" by metal stop 25, which is welded into place.

Figure 4B:
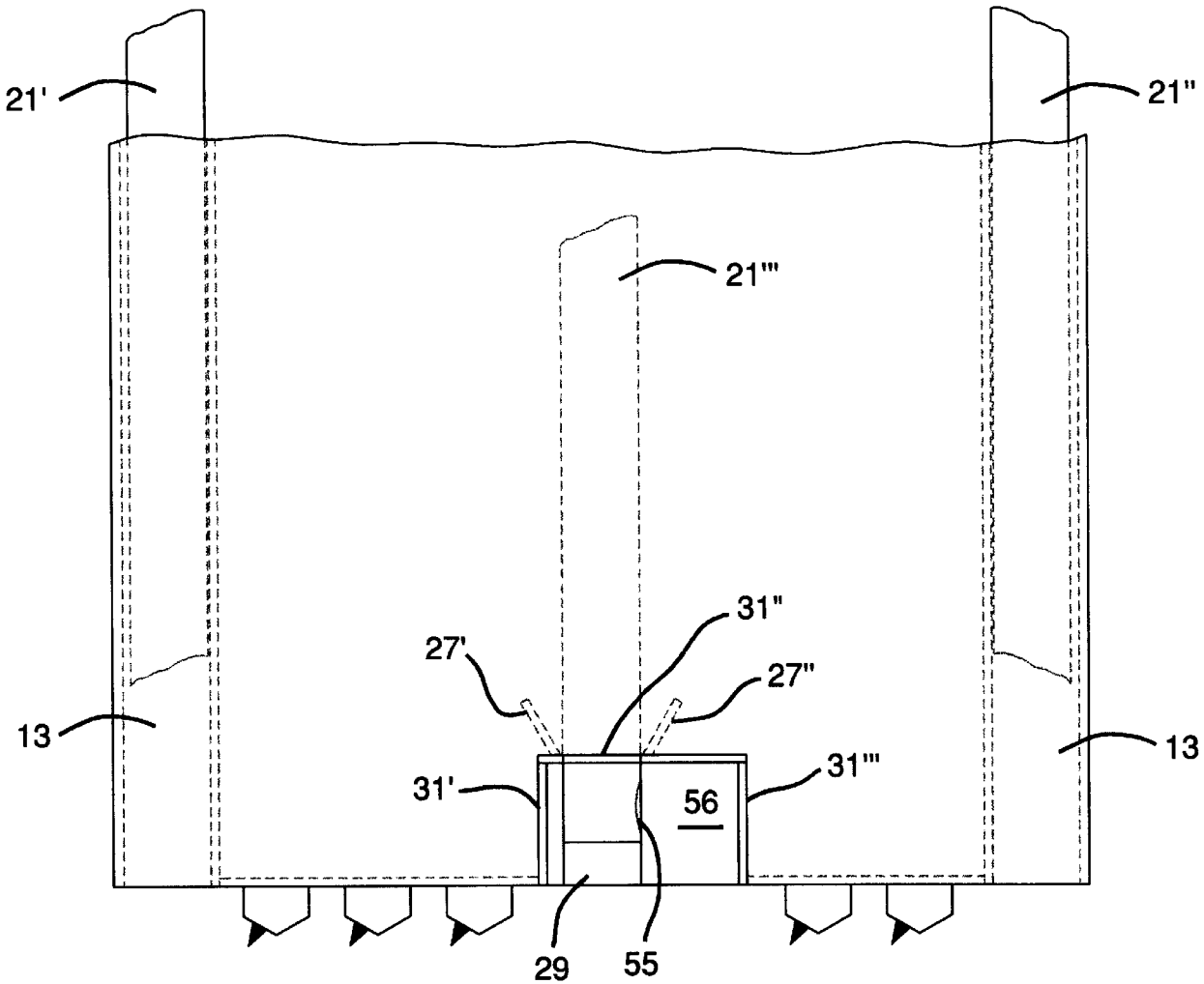
FIG. 4B is a side view of the core barrel particularly showing details of a tube system for delivering cementitious material to the cutting face of the core barrel

FIG. 4B shows in detail a particular arrangement of tubes for efficient introduction of drilling fluid or cementitious material into the annular kerf. Tubes 21', 21" and 21'" extend downward through channel 13. For simplicity, the detail of the termination of tube 21'" is not shown in connection with tubes 21' and 21", nor is there illustrated a fourth tube behind tube 21'", although the existence of these components will be understood. Guide plates 27' and 27" aid in the insertion of tube 21'" from above. Sealing plates 31', 31" and 31'" form a cavity 56 into which drilling fluid or cementitious material is pumped through aperture 55, which preferably have a diameter of about 1¾ inches. Cavity 56 is sealed off from channel 13 to prevent drilling fluid, cementitious material and cuttings from entering channel 13 from below. The end of tube 21'" is fitted with removable plug 29 to permit cleaning of the tube should it become clogged or obstructed.

Figure 6:
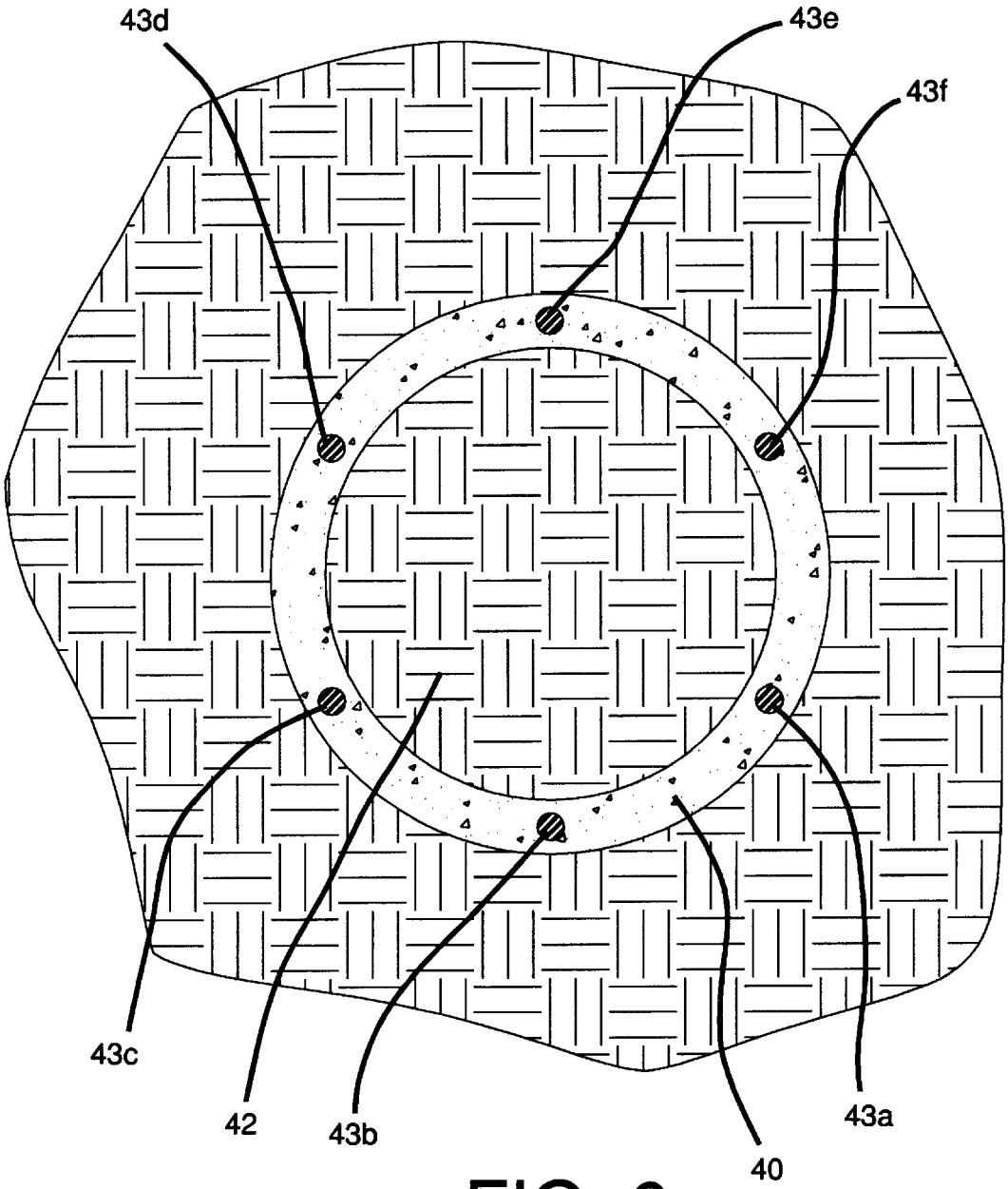
FIG. 6 is a horizontal cross-section, taken along section A—A of FIG. 4A, of a reinforced shell pile according to the present invention.

As shown in FIG. 6, cylindrical shell 40 is preferably reinforced against tension loads, which are commonly presented when multiple piles are clustered under a cap. Reinforcement means placed within cylindrical shell 40 enhance the shell's capability to withstand such tension forces, as well as tension and shear forces produced by other phenomena. Thus there is shown in FIG. 6 a cross-section, taken along section A—A of FIG. 4A, of a shell pile including reinforcement bars 43*a*, 43*b*, 43*c*, 43*d*, 43*e*, and 43*f*. These reinforcement bars are preferably constructed of steel, placed equidistant around the circumference of cylindrical shell 40, and tied together to form a cage. The cage is pushed into the cementitious material forming cylindrical shell 40 after placement thereof. Alternatively, if the cage is to be quite long or the cementitious material is too viscous, the cage may be loaded inside core barrel 6 prior to drilling and left inside annular kerf 18 upon withdrawal of the core barrel. The latter technique may require that core barrel 6 be provided with a sacrificial cutting edge which remains in annular kerf 18 with the cage, and that tubes for pumping cementitious material between the inner and outer walls of the core barrel not be used.

Techniques may be employed to prevent earthen core 42 from being lifted and broken by the withdrawal of core barrel 6 from annular kerf 18. Friction between the outer surface of earthen core 42 and the inner surface of core barrel 6 may tend to lift and break earthen core 42 as core barrel 6 is withdrawn from the kerf. In addition, withdrawal of core barrel 6 may induce a partial vacuum within the core barrel above earthen core 42, which also tends to lift the earthen core. As shown in FIG. 4A, a weight 19 is preferably disposed within core barrel 6 to prevent lifting of earthen core 42. Weight 19 slides freely inside core barrel 6 and rests on top of earthen core 42 as core barrel 6 descends during drilling and as core barrel 6 is withdrawn. As core barrel 6 is completely withdrawn from annular kerf 18, weight 19 is preferably retained within core barrel 6 by retaining means such as cutter bases 17', 17", 17'", and 17"" (FIG. 5), which protrude past the inner surface of core barrel 6. Alternatively, the retaining means may comprise a plurality of inwardly directed cutters 16'.

Alternatively or in addition to the use of weight 19, there is provided a vacuum relief mechanism 3 (FIG. 3A) to prevent the build-up of a vacuum within core barrel 6 above earthen core 42 when the core barrel is withdrawn. Vacuum relief mechanism 3 is preferably a simple rubberized flap which admits air into core barrel 6 to minimize any vacuum effect which might otherwise tend to lift or break earthen core 42. The use of high frequency vibration during withdrawal of core barrel 6 and the pressurization of the inside of core barrel 6 may also be used, either alone or in combination with the foregoing techniques, to prevent lifting of earthen core 42.

Figure 7:
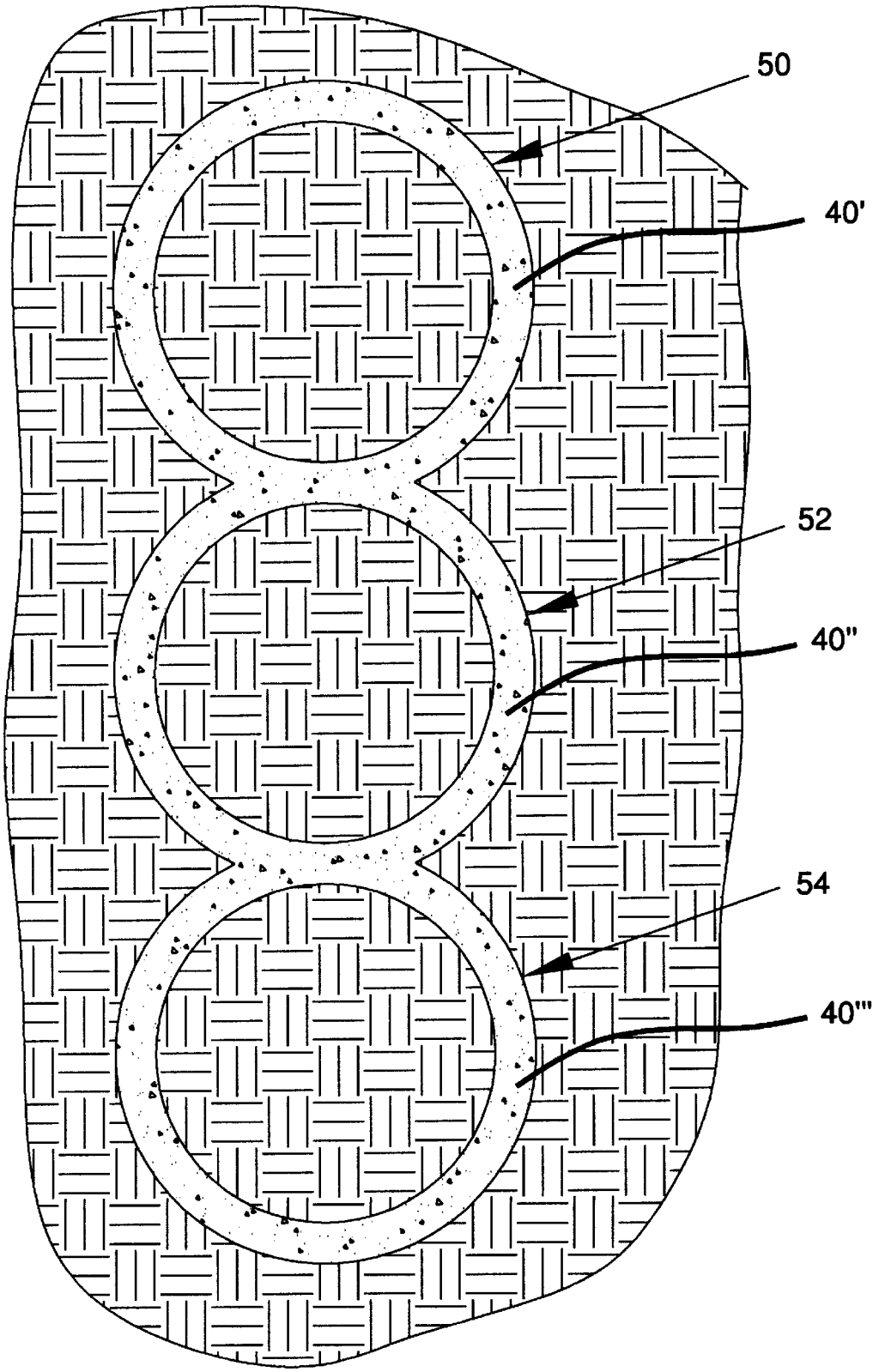
FIG. 7 is a top plan view of secant wall piles formed from cast-in-place shell piles of the present invention.

A plurality of such shell piles may be employed to form secant wall piles, as shown in FIG. 7. In this arrangement, a first shell pile 50 and a third shell pile 54 are typically constructed first, and their cementitious shells are allowed to cure. A second shell pile 52 is then drilled adjacent to both of them such that its cylindrical shell 40" intersects the cylincrical shell 40' of first shell pile 50 and the cylindrical shell 40'" of third shell pile 54. Thus there is formed a cementitious barrier against the lateral migration of moisture, contaminants, and other substances. The actual number of shell piles employed will depend on the diameter of the piles, the spacing between them, and the length of the barrier to be formed.

It will be understood that the cast-in-place shell pile described above may be employed in applications wherein the primary objective is to reinforce, solidify, or improve soil, rather than to support a load placed on top of the pile. The shell pile may be formed in any soil environment wherein it is desired to prevent soil subsidence; neutralize soil contaminants by mixing cementitious material with the soil; or simply alter the gross compositional characteristics of a volume of soil or earthen material.

While a particular embodiment of the invention has been illustrated and described, it will be obvious to those skilled in the art that various changes and modifications may be made without sacrificing the advantages provided by the principle of construction disclosed herein.

What is claimed is:

1. A pile capable of bearing a load offered by a foundation while minimizing the amount of material needed for the pile's construction, comprising:

a substantially vertical cementitious cylindrical shell having an outer diameter of at least about 30 inches and a length of at least about 30 feet, said shell being formed by placing cementitious material in an annular kerf cut by a rotating core barrel; and an earthen core inside said shell for transferring load from the shell and providing end bearing capabilities.

2. The pile of claim 1, further comprising reinforcing means within said cylindrical shell to reinforce the pile against tension forces.

3. The pile of claim 1, wherein said shell has a thickness of approximately three inches.

4. The pile of claim 1, wherein said cementitious material comprises cuttings removed from said annular kerf during cutting by said core barrel.

5. The pile of claim 4, further comprising reinforcing means within said cylindrical shell to reinforce the pile against tension forces.

6. The pile of claim 4, wherein said shell has a thickness of approximately three inches.

7. A method of constructing a pile while minimizing the amount of material needed for the pile's construction, comprising the steps of:

rotating a core barrel to drill a substantially vertical annular kerf around an earthen core, said kerf having an outer diameter of at least about 30 inches and a length of at least about 30 feet; and placing a cementitious material into said annular kerf, thereby forming a cementitious cylindrical shell around said earthen core.

8. The method of claim 7, wherein said cementitious material comprises cuttings removed from said annular kerf during cutting by said core barrel.

9. The method of claim 8, further comprising the step of removing said core barrel from said annular kerf, said placing step substantially coinciding with said removing step.

10. The method of claim 9, further comprising the step of retaining said earthen core during said removing step with a weight disposed inside said core barrel.

11. A method of constructing a cementitious shell pile for supporting a load while minimizing the amount of material needed for the pile's construction, comprising the steps of:

drilling a substantially vertical annular kerf around an earthen core with a rotating core barrel;

circulating a drilling fluid into said annular kerf, thereby removing cuttings from the kerf with said drilling fluid;

removing said core barrel from said annular kerf; and placing a cementitious material into said annular kerf during said removing step to form a cementitious cylindrical shell around said earthen core.

12. The method of claim 11, wherein said core barrel has an inner wall and an outer wall defining a channel for receiving said drilling fluid.

13. The method of claim 11, further comprising the step of separating cuttings from said drilling fluid to permit recirculation of said drilling fluid into said annular kerf.

14. The method of claim 13, further comprising the step of mixing said separated cuttings with cement to form said cementitious material.

15. The method of claim 14, wherein said core barrel has an inner wall and an outer wall defining a channel for receiving said drilling fluid and placing said cementitious s material into said annular kerf.

16. A method of constructing a pile for supporting a load while minimizing the amount of material needed for the pile's construction and minimizing the amount of spoil to be disposed of after excavation, comprising the steps of:

drilling an annular kerf around an earthen core with a rotating core barrel;

circulating a drilling fluid into said annular kerf, thereby removing cuttings from the kerf with said drilling fluid;

mixing a portion of said cuttings with cement to form a cementitious material;

removing said core barrel from said annular kerf; and placing a cementitious material into said annular kerf during said removing step to form a cementitious cylindrical shell around said earthen core.

17. A method of providing a barrier against the lateral migration of substances in soil with secant wall piles, comprising the steps of:

constructing a plurality of adjacent, substantially parallel, cast-in-place shell piles, each of said shell piles being formed by:

(a) rotating a core barrel to drill an annular kerf around an earthen core; and (b) placing a cementitious material into said annular kerf, thereby forming a cementitious cylindrical shell around said earthen core;

each of said cylindrical shells intersecting the cylindrical shell of an adjacent shell pile to form a cementitious barrier.

18. The method of claim 17, wherein said cementitious material comprises cuttings removed from said annular kerf during cutting by said core barrel.

19. The method of claim 18, further comprising the step of removing said core barrel from said annular kerf, said placing step substantially coinciding with said removing step.

20. The method of claim 19, further comprising the step of retaining said earthen core during said removing step with a weight disposed inside said core barrel.

* * * * *